US005950932A

United States Patent [19]

Takeda et al.

[11] Patent Number: 5,950,932

[45] Date of Patent: Sep. 14, 1999

[54] FUEL INJECTION VALVE

[75] Inventors: Hideto Takeda, Kariya; Eiji Iwanari, Chiryu, both of Japan

[73] Assignee: Denso Corporation, Kariya, Japan

[21] Appl. No.: 09/016,648

[22] Filed: Jan. 30, 1998

[30] Foreign Application Priority Data

Feb. 6, 1997 [JP] Japan ..... 9-23484

[51] Int. Cl.[6] ..... F02M 51/06

[52] U.S. Cl. ..... 239/585.4; 239/585.1; 251/129.21

[58] Field of Search ..... 239/585.1, 585.3, 239/585.4, 585.5, 900; 251/129.21

[56] References Cited

FOREIGN PATENT DOCUMENTS 0 177 719 4/1986 European Pat. Off. .

60-88070 6/1985 Japan .

OTHER PUBLICATIONS

Journal of Nippondenso Technical Disclosure No. 64–053, Mar. 1989.

*Primary Examiner*—Lesley D. Morris
*Attorney, Agent, or Firm*—Nixon & Vanderhye P.C.

[57] ABSTRACT

A fuel injection valve is composed of a stationary core, a driving coil, a movable core driven by the driving coil, a valve seat having a nozzle and a valve member integrated with the movable. The movable core is made of powdered soft magnetic material and the valve member is made of powdered hard non-magnetic material, and the movable core and the valve member are molded with resin. The movable core is sintered and hardened and the valve member is annealed thereafter. Preferably, the movable core is made of ferritic stainless steel, and the valve member is made of martensitic stainless steel.

5 Claims, 4 Drawing Sheets

FUEL INJECTION VALVE

CROSS REFERENCE TO RELATED APPLICATION

The present application is based on and claims priority from Japanese Patent Applications Hei 9-23484 filed on Feb. 6, 1997, the contents of which are incorporated herein by reference.

BACKGROUND OF THE INVENTION

1. Field of the Invention

The present invention relates to an electromagnetically controlled fuel injection valve.

2. Description of the Related Art

A fuel injection valve which is composed of a movable core driven by an electromagnet coil against biasing force of a spring and a stationary core is disclosed in JP-U-60-88070 and JOURNAL OF NIPPONDENSO TECHNICAL DISCLOSURE BULLETIN No. 64-053. JP-U-60-88070 discloses a valve body which has a sintered hard surface to increase mechanical strength. NIPPONDENSO TECHNICAL DISCLOSURE BULLETIN No. 64-053 discloses a moving unit in which a valve body and a movable core are molded with compound of resin and soft ferrite.

However, the thickness of the sintered surface of the valve body disclosed above can be several tens of micro meters at most, and it is difficult to keep the hardened surface if the valve body is machined to have precise finished sizes. On the other hand, the moving unit molded with the resin and soft ferrite compound does not have sufficient hardness to ensure high mechanical strength.

SUMMARY OF THE INVENTION

Therefore, it is a main object to provide an improved wear-resistant moving unit which can be machined precisely.

For this purpose, in a fuel injection valve which comprises a stationary core, a driving coil disposed around the stationary core, a movable core driven by the driving coil, a valve seat having a nozzle and a valve member integrated with the movable core, the movable core is made of powdered soft magnetic material and the valve member is made of powdered hard non-magnetic material. Preferably, the movable core is sintered and hardened and the valve member is annealed thereafter.

Therefore, the thickness of the sintered surface of the valve member can keep hardened surface even if the valve member is machined to have precise finished sizes. In addition, the movable core can have a sufficient permeability to provide an efficient fuel injection valve.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

Figure 1:
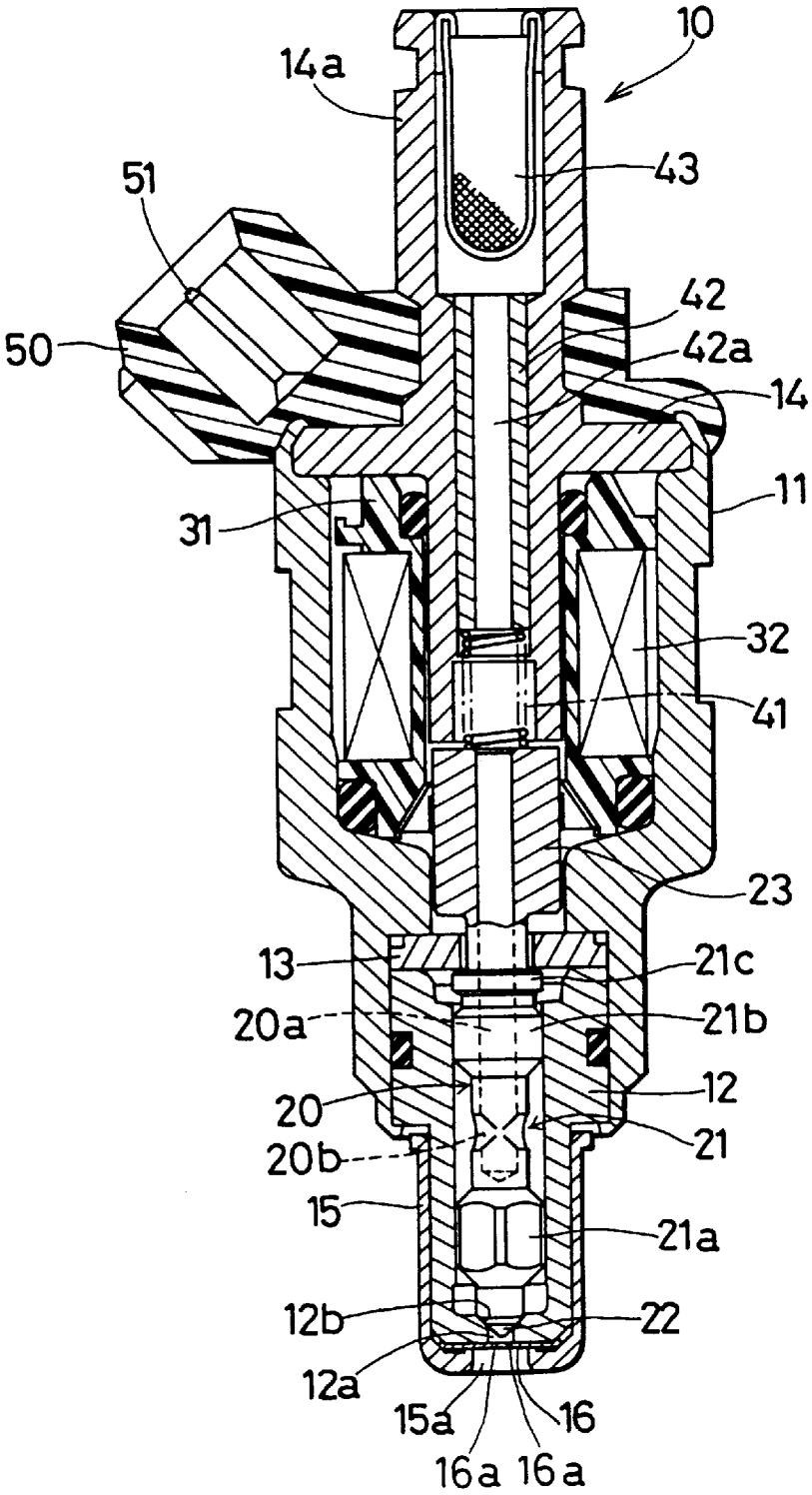
FIG. 1 is a longitudinally cross-sectional view illustrating a fuel injection valve according to a first embodiment of the present invention.

DETAILED DESCRIPTION OF THE PREFERRED EMBODIMENTS (First Embodiment)

A fuel injection valve 10 according to a first embodiment of the present invention is described with reference to FIG. 1.

A nozzle body 12 and a spacer 13 of a fuel injection valve 10 are inserted in a housing 11. The nozzle body 12 is caulked to an end of the housing 11. The other end of the housing 11 holds a stationary core 14. A tapered or conical valve seat 12*b* is formed on the inner periphery of an aperture 12*a* disposed at the bottom of the nozzle body 12. A nozzle plate 16 which has a plurality of nozzles 16*a* is inserted between the nozzle body 12 and a nozzle holder 15. The nozzle holder 15 is laser-welded to the outer periphery of the nozzle body 12. The aperture 15*a* and the nozzles 16*a* are connected with each other.

A moving unit 20 is composed of a movable core 23 and a needle valve 21. The needle valve 21 is made of non-magnetic martensitic-stainless steel such as SUS 440, and the movable core 23 is made of soft-magnetic ferritic-stainless steel such as SUS 410. They are sintered and integrated into a unit. The needle valve 21 has sliding portions 21*a* and 21*b*, which are slidably supported inside the nozzle body 12. The sliding portion 21*a* has cut surfaces which provide fuel passage between the sliding surface 21*a* and the inner periphery of the nozzle body 12. The needle valve 21 has a stopper 21*c* which engages the spacer 13 when the needle valve 21 is lifted.

The moving unit 20 has a longitudinal aperture 20*a* connecting to the inside of the stationary core 14 and side apertures 20*b* formed between the sliding surface 21*a* and the sliding surface 21*b* to connect the longitudinal aperture 20*a* and the fuel passage around the sliding surface 21*a*. The fuel supplied from a fuel inlet 14*a* of the stationary core 14 flows through a passage 42*a* of an adjusting pipe 42 disposed inside the stationary core 14, the longitudinal aperture 20*a*, the side apertures 20*b*, the fuel passage formed around the sliding surface 21*a* to the aperture 12*a*. When a conical valve member 22 formed on the edge of the needle valve 21 is unseated from the valve seat 12*b*, the fuel is injected through the aperture 12*a* from the nozzles 16*a*.

The movable core 23 is formed integrally with the needle valve 21 on the side of the spacer 13 opposite the nozzles 16*a* to be opposite to the stationary core 14 in the axial direction at an interval. An end of the spring 41 is in contact with the movable core 23, which is biased toward the nozzle 16*a*. The other end of the spring 41 is in contact with the adjusting pipe 42. The adjusting pipe 42 is press-fitted to the inner periphery of the stationary core 14. The biasing force of the spring 41 is adjusted by changing the position of the adjusting pipe 42 relative to the stationary core 14. However, it is possible to form a female screw around the adjusting pipe 42 to fix the same to the stationary core 14 by screwing. A fuel filter 43 is disposed in a fuel inlet 14*a* formed at the end of the stationary core 14 opposite the movable core 13.

A bobbin 31 has a coil 32 and is disposed around the stationary core 14. The coil 32 is connected to a terminal 51 which is held in a connector 50 and supplied with electric power via the terminal 51.

The operation of the fuel injection valve is described below.

(1) When the coil 32 is not supplied with electric power, the movable core 23 is biased against the nozzles by the spring 41, and the valve member 22 of the needle valve 21 is seated on the valve seat 12*b*. Thus, the fuel is not injected from the nozzles 16*a*.

(2) When the coil 32 is supplied with electric power, the movable core 23 is driven by coil 32 against the biasing force of the spring 41 and the needle valve 21 is lifted, thereby unseating the valve member 22 from the valve seat 12*b*. Consequently, fuel supplied to the fuel inlet 14*a* is injected from the nozzles 16*a*. Because the stopper 21*c* engages the spacer 13, the movable core 23 is not brought into contact with the stationary core 14.

(3) Because there is an air gap between the movable core 23 and the stationary core 14, the valve member 22 can be separated without delay irrespective of remanent magnetism of the cores 14 and 23.

A method of manufacturing the moving unit 20 is described below.

(1) Powder material mainly including non-magnetic martensitic-stainless-steel is filled into a portion of sintering die for the needle valve 21, powder material mainly including soft-magnetic ferritic-stainless-steel is filled into a portion of the same die for the movable core 23, and they are sintered.

(2) After sintering, they are hardened in a vacuum to increase hardness of the needle valve 21. In order to strenghten the movable core 23 after the hardening, the coil 32 is powered to generate high frequency magnetic flux and provide the movable core with eddy current, thereby annealing the movable core.

(3) The moving unit is machined to have precise finished sizes.

Figure 2A:
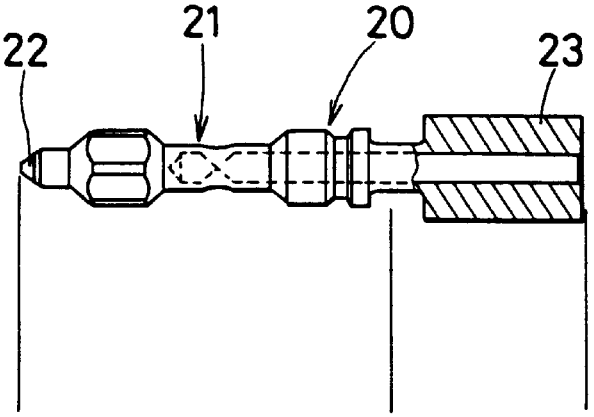
FIG. 2A is a schematic diagram showing a moving unit of the fuel injection valve according to the first embodiment.
Figure 2B:
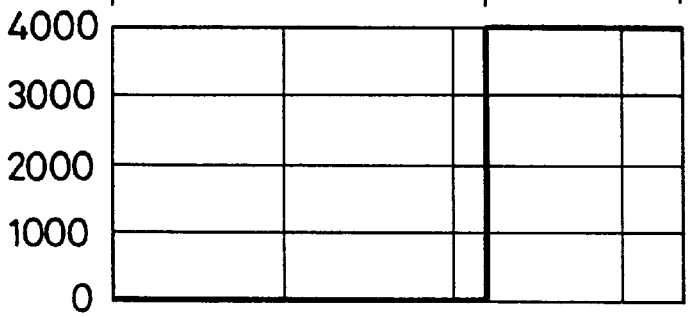
FIGS. 2B–2D are graphs showing characteristics of the valve according to the first embodiment.
Figure 2C:
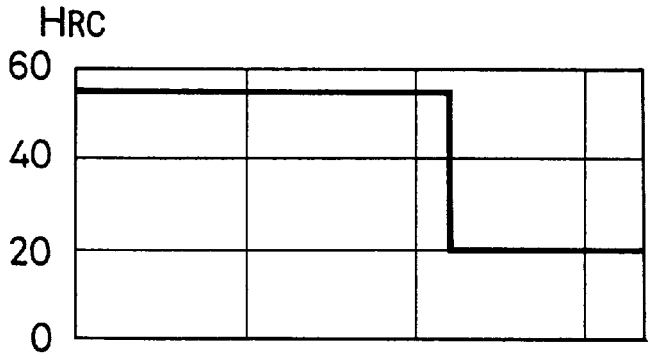
Figure 2D:
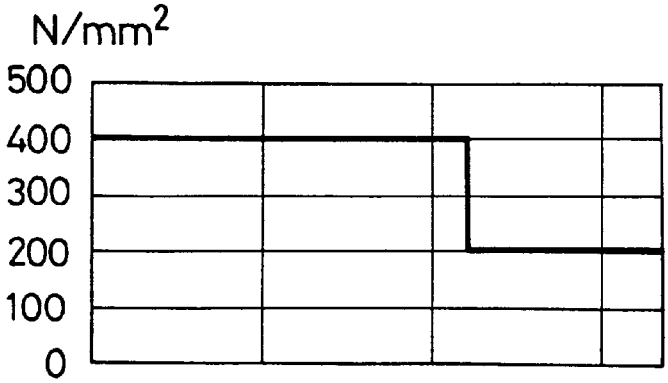

FIGS. 2B–2D show characteristics of the needle valve 21 and the movable core 23 corresponding to portions of the moving unit shown in FIG. 2A.

As shown in FIG. 2B, the maximum magnetic permeability of the needle valve 21 is much lower than that of the movable core 23. The hardness (Hrc) and the yield strength ($N/mm^2$) of the needle valve 21 are much higher than those of the movable core 23 as shown in FIG. 2C and FIG. 2D.

(Second Embodiment)

Figure 3:
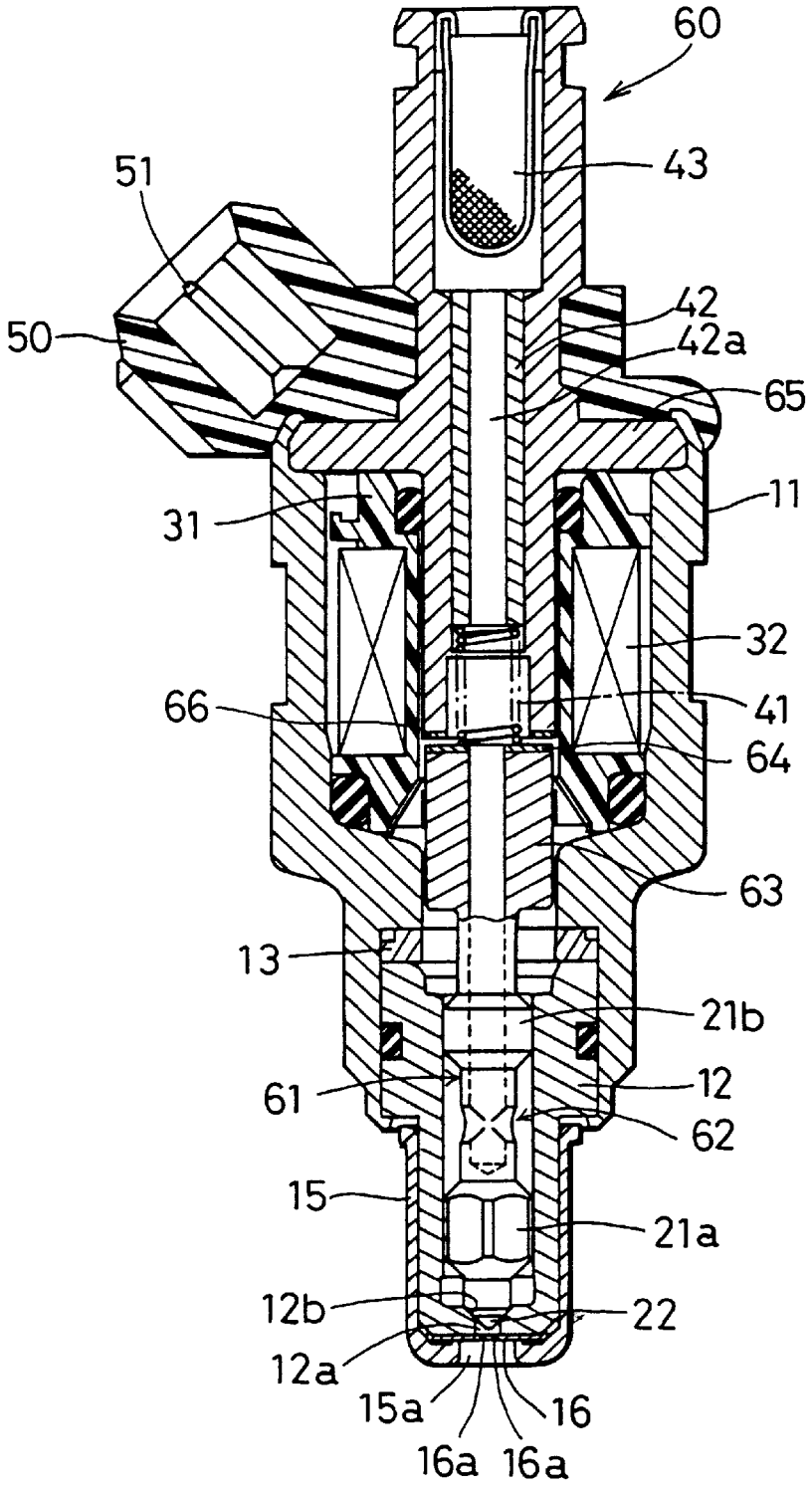
FIG. 3 is a longitudinally cross-sectional view illustrating a fuel injection valve according to a second embodiment of the present invention.
Figure 4:
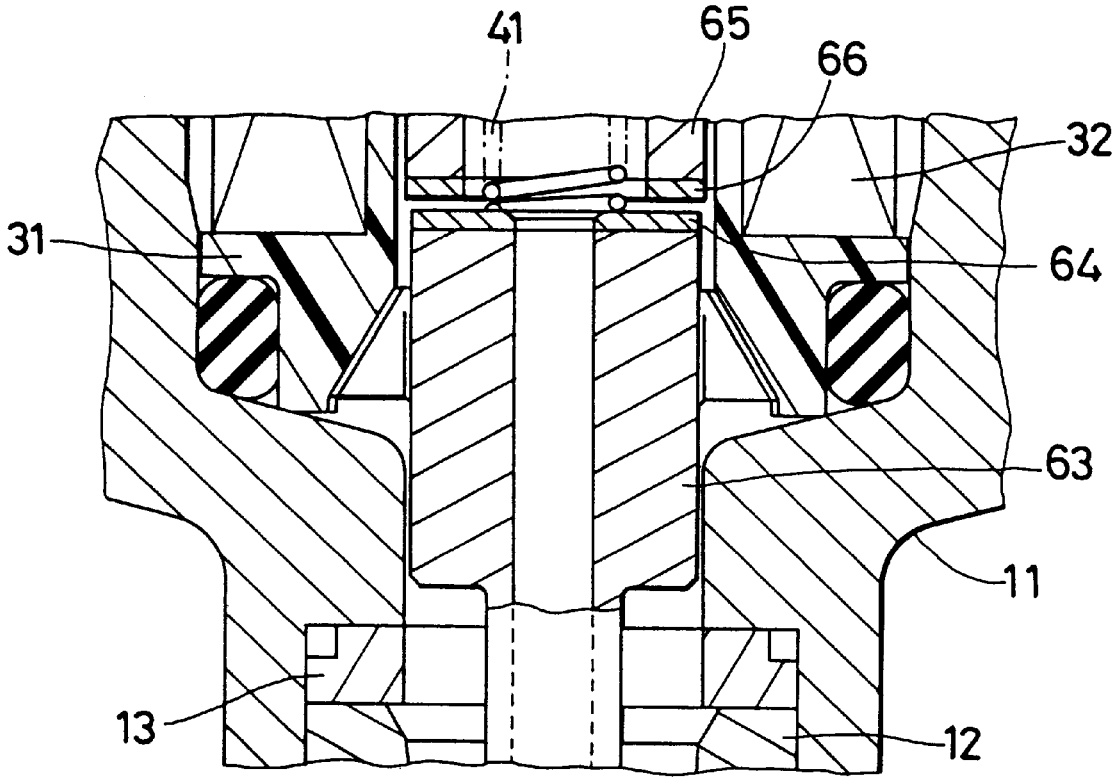
FIG. 4 is an enlarged fragmentary view illustrating a movable core and a stationary core of the valve according to the second embodiment.

A fuel injection valve 60 according to a second embodiment of the invention is described with reference to FIG. 3 and FIG. 4, where the same or substantially the same parts as those shown in FIG. 1 are denoted by the same reference numerals.

A moving unit 61 of the fuel injection valve 60 is composed of a needle valve 62 and a movable core 63. The needle valve 62 has a high hardness, and the movable core 63 has a high magnetic permeability. The needle valve 62 and the movable core 63 are manufactured with the same method as the first embodiment. The opposite surfaces 64 and 66 of the movable core 63 and a stationary core 65 are plated with chromium as shown in FIG. 4. This structure can omit the stopper 21*c* of the first embodiment. Because of the surfaces 64 and 66 plated with the non-magnetic chromium plate, the movable core 63 can separate from the stationary core without delay when the coil 32 is energized.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A fuel injection valve comprising:

a stationary core;

a driving coil disposed around said stationary core;

a movable core driven by said driving coil;

a valve seat having an aperture; and a valve member integrated with said movable core opening and closing said aperture when said movable core is driven by said driving coil, wherein said movable core is made of powdered soft magnetic material and said valve member is made of powdered hard non-magnetic material.

2. A fuel injection valve as claimed in claim 1, wherein said movable core is sintered and hardened and said valve member is annealed thereafter.

3. A fuel injection valve as claimed in claim 2, wherein said movable core and said valve member are molded with resin.

4. A fuel injection valve as claimed in claim 2, wherein, said movable core is made of ferritic stainless steel, and said valve member is made of martensitic stainless steel.

5. A fuel injection valve as claimed in claim 2, wherein said movable core is annealed by supplying high frequency electric power to said driving coil.

* * * * *